US005311832A

United States Patent [19]

Payne

[11] Patent Number: 5,311,832

[45] Date of Patent: May 17, 1994

[54] ADVANCED MARINE VEHICLES FOR OPERATION AT HIGH SPEEDS IN OR ABOVE ROUGH WATER

[75] Inventor: Peter R. Payne, Severna Park, Md.

[73] Assignee: Dynafoils, Inc., Severna Park, Md.

[21] Appl. No.: 810,869

[22] Filed: Dec. 20, 1991

[51] Int. Cl.[5] ..... B63B 1/24

[52] U.S. Cl. ..... 114/274; 114/280

[58] Field of Search ..... 114/274–282

[56] References Cited

U.S. PATENT DOCUMENTS

| | | | |
|---|---|---|---|
| 796,846 | 8/1905 | De Lambert | 114/271 |
| 1,107,260 | 8/1914 | Burney | 114/274 |
| 1,301,917 | 4/1919 | De Bolotoff | 114/274 |
| 1,752,406 | 4/1930 | Wetch | 114/274 |
| 1,818,309 | 4/1931 | De Villard | 244/42 |
| 1,878,775 | 9/1932 | Henry | 244/42 |
| 2,603,179 | 7/1952 | Gardiner | 114/66.5 |
| 2,749,870 | 6/1956 | Vavra | 114/66.5 |
| 2,771,051 | 11/1956 | Von Schertel | 114/66.5 |
| 2,930,338 | 3/1960 | Flomenhoft | 114/66.5 |
| 3,044,432 | 7/1962 | Wennagel et al. | 114/66.5 |
| 3,104,642 | 9/1963 | Piazza | 114/66.5 |
| 3,141,437 | 7/1964 | Bush et al. | 114/66.5 |
| 3,183,871 | 5/1965 | Reder | 114/66.5 |
| 3,236,202 | 2/1966 | Quady et al. | 114/279 |
| 3,270,699 | 9/1966 | Bush | 114/66.5 |
| 3,324,815 | 6/1967 | Morales | 114/66.5 |
| 3,417,722 | 12/1968 | O'Neill | 114/66.5 |
| 3,456,611 | 7/1968 | Johnson | 114/66.5 |
| 3,499,412 | 3/1970 | Anthes et al. | 115/42 |
| 3,547,063 | 12/1970 | Follett | 114/66.5 |
| 3,710,747 | 1/1973 | Guidi | 114/275 |
| 3,722,450 | 5/1973 | Arimura | 114/66.5 H |
| 3,760,756 | 9/1973 | Boden | 114/66.5 S |
| 3,762,355 | 10/1973 | Raynes | 114/272 |
| 3,763,810 | 10/1973 | Payne | 114/66.5 |
| 3,797,434 | 3/1974 | Matthews | 114/66.5 H |
| 3,812,806 | 5/1974 | Korotkov et al. | 114/66.5 H |
| 3,949,695 | 4/1976 | Pless | 114/66.5 H |
| 3,977,348 | 8/1976 | Bordat et al. | 114/66.5 H |
| 4,606,291 | 8/1986 | Hoppe | 114/61 |
| 4,665,853 | 5/1987 | Gerdsen et al. | 114/61 |
| 4,748,929 | 6/1988 | Payne | 114/280 |
| 4,896,621 | 1/1990 | Coles | 114/274 |
| 4,926,773 | 5/1990 | Manor | 114/61 |
| 4,949,919 | 8/1990 | Wajnikonis | 244/35 R |

FOREIGN PATENT DOCUMENTS

| | | | |
|---|---|---|---|
| 768045 | 4/1955 | Fed. Rep. of Germany | 114/279 |
| 1193821 | 5/1965 | Fed. Rep. of Germany . | |
| 863288 | 1/1941 | France | 114/279 |
| 1272736 | 8/1961 | France . | |
| 150392 | 7/1984 | Norway . | |
| 8401137 | 3/1984 | PCT Int'l Appl. . | |
| 572413 | 10/1945 | United Kingdom . | |

*Primary Examiner*—Edwin L. Swinehart

*Attorney, Agent, or Firm*—Leydig, Voit & Mayer

[57] ABSTRACT

A hydrofoil craft which possesses at least one hull, at least one support arm which extends from said hull into the water and which is connected to the hull, at least one foil attached to each support arm, and preferably at least one shock strut per support arm which pivotally connects said hull to the support arm, so that said shock struts allow the support arm and the foil to move in concert with the upgusts and downgusts of water velocity located near the foil so as to enable said hydrofoil craft to maintain approximately constant lift. The principles involved are also applicable to aircraft of the "wing in ground effect" type which is designed to fly close to the water's surface so as to take advantage of the favorable aerodynamic effects of the water's proximity.

12 Claims, 8 Drawing Sheets

ADVANCED MARINE VEHICLES FOR OPERATION AT HIGH SPEEDS IN OR ABOVE ROUGH WATER

FIELD OF THE INVENTION

The present invention relates generally to advanced marine vehicles ("AMV") and, specifically, to hydrofoil craft and wing in ground effect ("WIG") aircraft which are capable of being operated at high speeds in or above rough water.

BACKGROUND OF THE INVENTION

Dynamically supported AMVs cannot be operated comfortably at high speeds in or above rough water. Examples of such AMVs include air cushion vehicles, surface effect ships, wing in ground effect ("WIG") aircraft, and hydrofoil craft.

Hydrofoil craft are boats which typically possess a more or less conventional planing boat hull and which have one or more vertical struts extending from beneath the hull into the water. Each vertical strut typically carries at least one foil. When the hydrofoil craft has accelerated to a sufficient velocity through the water, the lift created by the foils raises the hull above the water's surface, thus eliminating the hull's resistance.

WIG aircraft, in contrast, are "flying boats" intended to cruise just above wave crests so as to avoid all but very occasional water contact during flight. WIG aircraft possess one or more wings which are generally three orders of magnitude larger than the foils of hydrofoil craft. When a WIG aircraft has accelerated to a sufficient velocity through the water, the aerodynamic lift created by these wings lifts the aircraft entirely out of the water. By remaining close to the water's surface, WIG aircraft encounter significantly less resistance than they would encounter at higher altitudes because their aerodynamic lift is much greater closer to the water's surface than it would be at higher altitudes.

Hydrofoils are often used to transport people and cargo across varying sea states However, hydrofoils are typically used in rough water only at reduced speeds. WIG aircraft have not yet been built commercially.

To determine how a hydrofoil craft could be operated at high speeds in rough waters without resulting in an uncomfortable ride, I engaged in a "time-domain analysis" in which the actual forces on a craft were calculated at successive time intervals. From these calculations, the craft's motion in space could be determined.

I performed a time-domain computer analysis to reconstruct the detailed shape of a random sea's surface (i.e., the random wave patterns), as a function of both time and space. The real random seas which are actually experienced can be thought of as the sum of many sinusoidal component waves where each individual wave component has its own orbital velocity A reconstruction of such a random sea was obtained by using wave components of equal energy rather than wave components of equal frequency in the method described in *Principles of Naval Architecture,* Society of Naval and Marine Engineers, Chp. 8 (1990). The resulting random seaway was found to follow the statistical theories postulated in Cartwright, D. E., and Longuet-Higgins, M. S., "The Statistical Distribution of the Maxima of a Random Function," *Proc. Roy. Soc.,* Ser. A, Vol. 237, pp.212–232 (1956).

Once realistic random seas could be computed, the water's movement and velocity below the water's surface could be studied. During this study, I discovered that the velocity of water in a seaway typically approximated the expected value for a sinusoidal wave train of the same average wave height and length. Periodically, however, the individual wave components would combine such that the aggregation of the components would result in much more or much less vertical velocity than would be the case for a single sinusoidal wave.

I believe that these occasionally extreme changes in vertical water velocity are at least partially responsible for the uncomfortable and sometimes injurious rides to which hydrofoil craft are subject in rough water, particularly when the occasionally extreme change in water velocity is a "downgust". When a foil is moving horizontally in the water and encounters such a downgust, the effect of this downgust, from the foil's point of view, is the same as if the foil were lifted rapidly upward. In either case, the "added mass" of the water in the vicinity of the foil imposes a large downward acting load on the foil.

The concept of "added mass" has been known to hydrodynamicists for at least two centuries, but is not well understood by most engineers. I have described the phenomenon in some detail in the first and second chapters of my book "Design of High Speed Boats: Volume 1, Planing", published by Fishergate, Inc., 2521 Riva Road, Annapolis, Md. 21401.

Roughly speaking, a submerged body (such as a foil) moving through the water displaces the water locally by its passage. The water is moved aside as the foil pushes by, and then more or less returns to where it was after the foil has passed. If the foil is moving at a constant speed, this movement of the water in its vicinity does not cause any resistance to the foil's motion. The resistance which does exist is due to the water's viscosity.

When the foil is accelerating to higher speeds, however, this moving aside of the water provides additional resistance to the acceleration, and so we call this effect "added mass". A given propulsive force causes the foil to accelerate less rapidly in water than it would in air, because of this added mass which is three orders of magnitude greater in water than in air because of water's much greater density. Conversely, the hydrodynamic force exerted on a foil, if the water is accelerating, is larger than its constant speed resistance.

Very roughly, the "added mass" of a high aspect ratio body like a foil is equal to the mass of water in a circular cylinder whose length is equal to the foil's span and whose diameter is equal to the foil's thickness or breadth measured at right angles to its direction of motion. Thus, if a foil has a span of ten feet, a chord of four feet and a thickness of 0.3 feet, its added mass for motion parallel to its chord will be about $$\left[\left[\frac{0.3}{2}\right]^2 \pi \times 10\right] \times 2 = 1.41 \text{ slugs (45.5 pounds)}$$

If, on other hand, its motion is at right angles to the chord, its added mass will be about $$\left[\left[\frac{4}{2}\right]^2 \pi \times 10\right] \times 2 = 251.3 \text{ slugs (8,088 pounds).}$$

Thus, although the "added mass" is not important for a foil's normal motion roughly parallel to its chord, it has a powerful effect on any vertical motion which may be superimposed on this generally horizontal motion. The added mass resists upward and downward acceleration of the foil. Conversely, it the water is accelerating vertically at ten feet per second per second (ft/sec$^2$), the vertical force on the foil, due to "added mass" alone, will be about $$251.3 \times 10 = 2{,}513 \textit{ pounds}$$

$$(\textit{mass}) \times (\textit{acceleration}) = (\textit{force})$$

Notice that this effect has nothing to do with the foil's angle of attack to the relative flow of water, so that it is not significantly influenced by changing the foil's angle to the flow.

Accordingly, when a hydrofoil craft encounters a downgust and tries to compensate for this downgust by changing the angle of incidence of its foils to increase lift, this compensation by itself is not sufficient to overcome the substantial downward impulse due to the water's added mass. In other words, merely changing the angle of incidence of the foil will not prevent a downgust of water from forcing the foil farther below the water's surface than it was prior to encountering the downgust. When the foil is attached to a conventional vertical strut which is rigid, the downgust of water will necessarily lower the hydrofoil craft's hull as well as the foil. If the downgust of water is sufficiently large, the craft's hull can be lowered enough so that the hull will impact the water's surface ("plough-in"), which is uncomfortable and occasionally dangerous.

U.S. Pat. Nos. 3,417,722 (O'Neill), No. 2,771,051 (Von Schertel) and No. 3,141,437 (Bush, et al.) are examples of previous efforts made in an attempt to create a hydrofoil craft which could operate at higher speeds in rough water. However, these three patents tried to solve this problem by merely changing the foil's angle of incidence to compensate for any changes in the orbital velocity of waves. As is alluded to previously, these attempts were unsuccessful because they did not take into account the "added mass" effect of the vertically moving water. Furthermore, merely "changing the [foil's angle of incidence] in an attempt to maintain an essentially constant angle of attack in waves is a self-defeating process [because] the inherent lags in the total system make this a practical impossibility." Ellsworth, W., "Hydrofoil Development—Issues and Answers," AIAA/SNAME Advanced Marine Vehicle Conference, Paper No. 74-306 (1974).

U.S. Pat. Nos. 3,456,611 (Johnson) and No. 2,930,338 (Flomenhoft) also attempted to create a smooth-riding hydrofoil craft by attaching springs or cylinders to the vertical struts of hydrofoils. However, neither of these patents addresses the problem created by the added mass effect. Johnson employs his vertical struts as "equalizers" (to stabilize the craft) and shock absorbers, while Flomenhoft uses his struts for "better cushioning." Thus, it has proven extremely difficult to devise a hydrofoil craft which can compensate for the "added mass" effect of water so as to enable it to operate at high speeds in rough water.

With respect to WIG aircraft, the orbital water velocities are unimportant because these aircraft are not in water contact. However, WIG aircraft are still subject to many changes in the lift of their wings. When a wave crest passes under a wing, the proximity of the crest causes the wing lift to increase (at constant speed and pitch angle) and the subsequent trough causes the lift to decrease. Moreover, any head or following wind follows the contours of the waves, moving upwards toward each crest and downwards toward each trough. If the wind is blowing strongly, the vertical components of its velocity can also induce an increase or decrease in lift.

For example, a WIG aircraft which is cruising at 500 knots over water which has a wavelength of 200 feet experiences a vertical vibration at about $$\frac{500 \times 1.687}{200} = 4.2 \text{ Hertz}$$

Clearly, a vertical vibration at this frequency could not be minimized by merely changing the wing angle of incidence or by cyclically moving the wing's trailing edge flaps to smooth out the lift vibrations. See generally Ellsworth, W., "Hydrofoil Development—Issues and Answers," AIAA/SNAME Advanced Marine Vehicle Conference, Paper No. 74-306 (1974). Thus, WIG aircraft, like hydrofoil craft, are subject to rough rides due to the changes in lift induced by the proximity of the sea's surface and by head or following winds.

Accordingly, there remains a need in the art for hydrofoil craft which can compensate for the random upgusts and downgusts of water velocity around its foils and which can maintain approximately constant lift so that the hull above the foils can ride smoothly at high speed in rough water. Furthermore, there also remains a need in the art for WIG aircraft which can compensate for the random changes in the lift of its wings so that the aircraft can fly comfortably just above the water's surface.

SUMMARY OF THE INVENTION

The present invention provides a hydrofoil craft which can compensate for the random upgusts and downgusts of water around its foils, which can operate at high speeds in rough water, and which can maintain approximately constant lift.

The present invention further provides a WIG aircraft which can compensate for the random changes in the lift of its wings and which can operate smoothly and efficiently close to the water's surface.

In accordance with the present invention, a hydrofoil craft comprising at least one hull, at least one support arm extending downward from the hull of the craft to the water's surface, means for connecting said support arms to said hull, and at least one foil attached to each support arm so that the support arms and the foils move in concert with the vertical upgusts and downgusts of water velocity located around the foils so as to enable the foils to maintain approximately constant lift.

Further in accordance with the present invention, a WIG aircraft comprising a fuselage, at least one support arm extending from the fuselage, means for connecting the support arm to the fuselage, and at least one wing attached to at least one support arm so that the support arms and the wings move in concert with the changes in the lift of its wings so as to enable the wings to maintain approximately constant lift.

DETAILED DESCRIPTION OF THE PREFERRED EMBODIMENT

A unique hydrofoil craft 10 is capable of operating at high speeds in rough water. The hydrofoil craft 10 has at least one hull 12 of a desired configuration. Preferably, the hull 12 possesses a configuration which enables the hull 12 to cut through the higher waves of a rough sea without experiencing large accelerations. An example of such a hull configuration is disclosed in my prior U.S. Pat. No. 3,763,810, incorporated herein by reference. The hull's slender configuration reduces the dynamic lift of the hull 12 when in contact with the water. Accordingly, the reduced plan area of the forward sections of the hull 12 minimizes dynamic lift forces during wave impacts, thus reducing both drag and vertical acceleration. A transom 14 can be incorporated in the bow of the hull 12. The bow transom helps to prevent complete bow submergence during severe wave impacts as taught in my prior patent.

Figure 3:
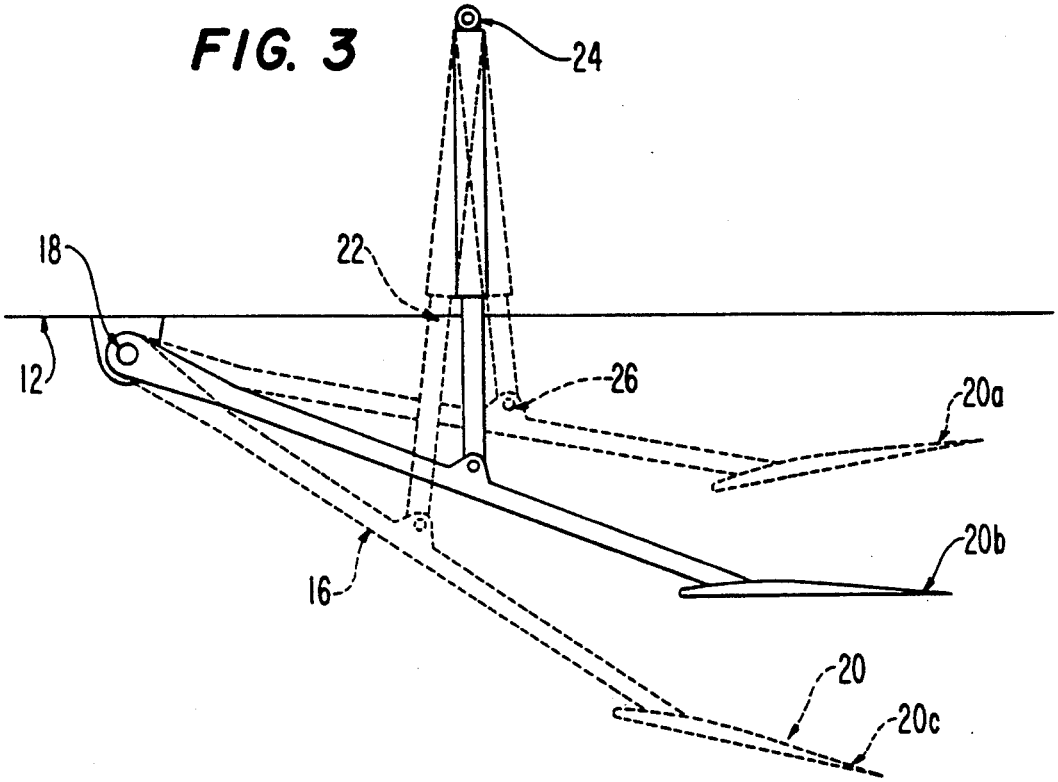
FIG. 3 is a schematic view illustrating the way in which support arms which extend angularly downward from the hull of the hydrofoil craft move in concert with the upgusts and downgusts of water velocity around the foils.
Figure 4:
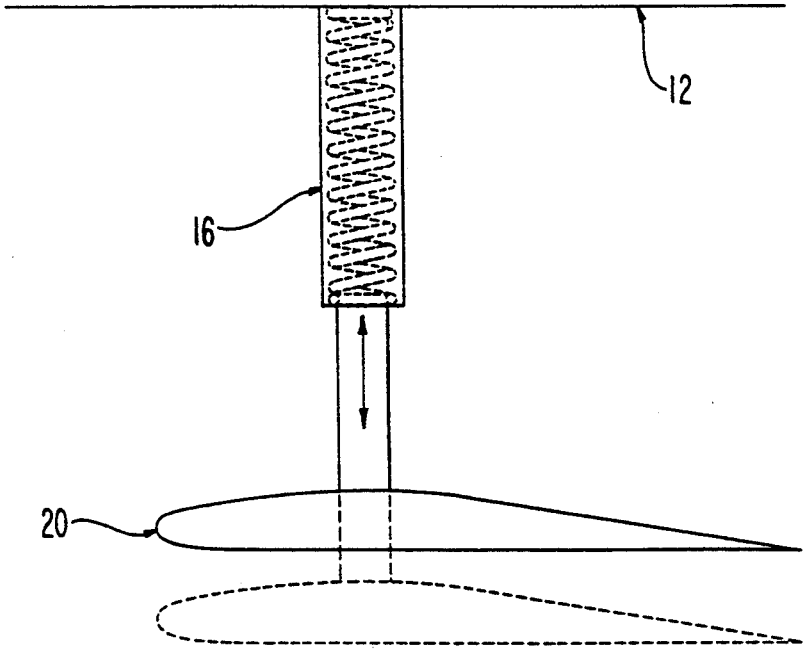
FIG. 4 is a schematic view showing the way in which support arms which extend vertically downward move in concert with the changes in water velocity around the foils.

In the present invention, at least one support arm 16 is attached to the hull 12, preferably at or near the bottom. The support arms 16 are attached so that they extend downward from the plane of the bottom of the hull 12 into the water. Preferably, the support arms 16 extend angularly downward from the hull 12 into the water, as is shown in FIG. 3. However, the support arms 16 can also extend vertically downward from the hull 12 into the water, as is shown in FIG. 4(*a*), the vertical motion being obtained by a telescoping mechanism. Preferably, at least two support arms 16 are attached to the hull 12: one support arm 16 located toward the rear of the hull 12 and another support arm 16 located toward the forward portion of the hull 12.

Figure 5:
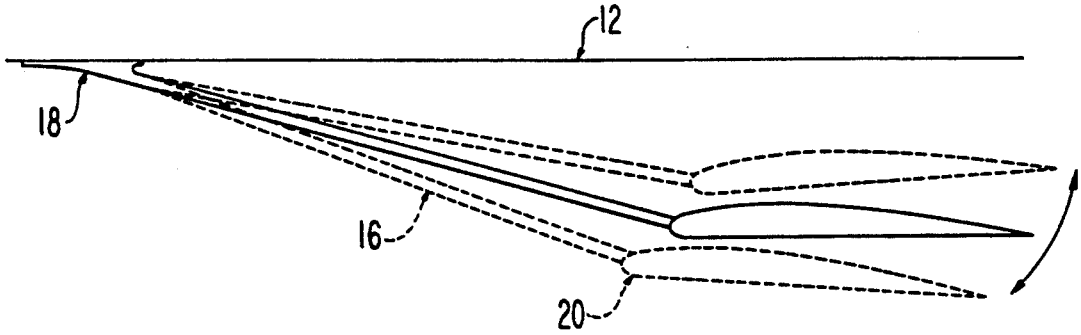
FIG. 5 is a schematic view depicting the way which flexible support arms move in concert with the changes in water velocity around the foils.

Each support arm 16 is attached at or near the bottom of the hull 12 at an attachment or connection 18. Attachment of each support arm 16 at or near the bottom of the hull 12 can be either pivotal or rigid. Where the attachment or connection 18 is rigid, each support arm 16 can be at least partially flexible: that is, each support arm 16 can be either uniformly flexible so that the support arm 16 bends throughout its entire length or only partially flexible (e.g., the support arm 16 can be rigid except near the attachment or connection 18 where the support arms 16 are thinner so as to allow the support arm 16 to bend only at this thin section), as is shown in FIG. 5. These flexible support arms can be made of any resilient material, such as fiberglass or steel.

Figure 6:
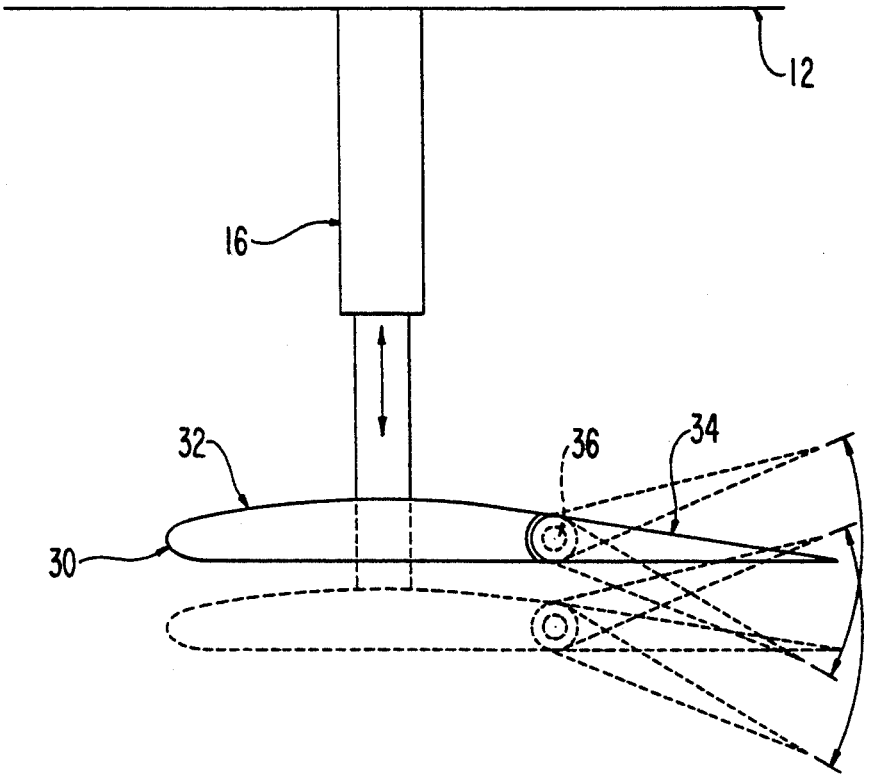
FIG. 6 is a side elevational view depicting a foil with a hinged flap.
Figure 11:
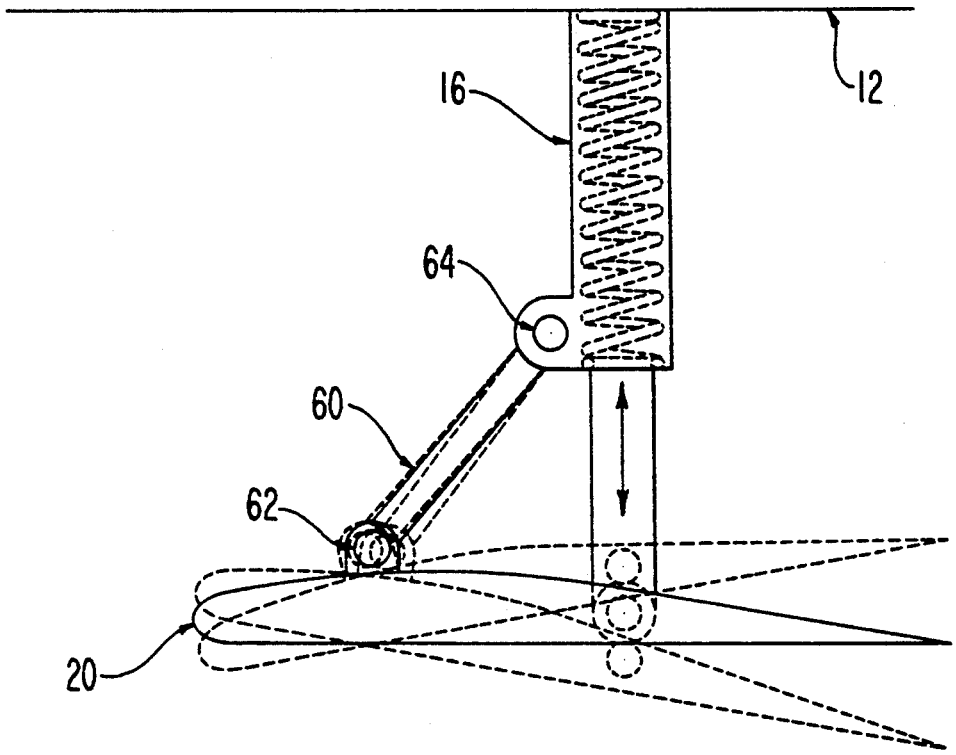
FIG. 11 is a side elevational view showing the way in which the angle of incidence at which foils, which are attached to support arms which extend vertically downward from the hull of the hydrofoil craft encounter approaching water can be adjusted through the use of a shock strut.

Furthermore, where the attachment or connection 18 is rigid and each support arm 16 is not at least partially flexible, each support arm 16 must extend vertically downward from the hull 12 of the hydrofoil craft 10 and must be telescoping in nature, as is shown in FIGS. 6 and 11. These telescoping support arms 16 are cylinders which move up and down in response to the changes in local water velocity around the foils 20. The telescoping nature of these support arms 16 allows the foils 20 to move in concert with the local changes in water velocity while allowing the hull 12 of the hydrofoil 10 to track a path of approximately constant elevation above the water.

In contrast, where the attachment or connection 18 is pivotal, each support arm 16 is preferably rigid, although each support arm 16 can be at least partially flexible in the manner previously described. Furthermore, the pivotal attachment can be by any means known in the art.

Each support arm 16 is also attached to a foil 20. In embodiments where two support arms 16 are attached to the hull 12, it is preferable to have a main foil 20*a*, which provides most of the hull's support while foil-borne, attached to the support arm 16 located near the longitudinal center of gravity of the hull 12, while a smaller foil 20*b* is attached to the support arm 16 located under a forward or aft position of the hull 12.

As is illustrated in FIG. 3, foil 20 is located near the water's surface during the operation of the hydrofoil craft 10. The foil 20 creates the lift necessary to elevate the hull 12 of the boat above the water's surface. As is well-known in the art, foils create the necessary lift through the angle of incidence at which the foils encounter the approaching water.

According to the present invention, the foils 20 can create the lift necessary to elevate the hull 12 of the hydrofoil craft 10 above the water's surface by having the angle of incidence at which the foils 20 encounter the approaching water adjusted in a number of ways including, but not limited to, employing a foil 30 with a hinged flap, or a tandem foil 40 or 50. FIG. 6 depicts a foil 30 with a hinged flap. The foil 30 has a main portion 32 of the foil 30 rigidly attached to the support arm 16. A rear flap 34 is pivotally attached to the main portion 32 of the foil 30 by any means known in the art, preferably a hinge, at a pivotal attachment or connection site 36.

When the foil 30 encounters an upgust or downgust of vertical water velocity, the rear flap 34 pivots and changes its orientation so that the effective angle of incidence at which the foil 30 encounters the approaching water is adjusted.

Figure 7:
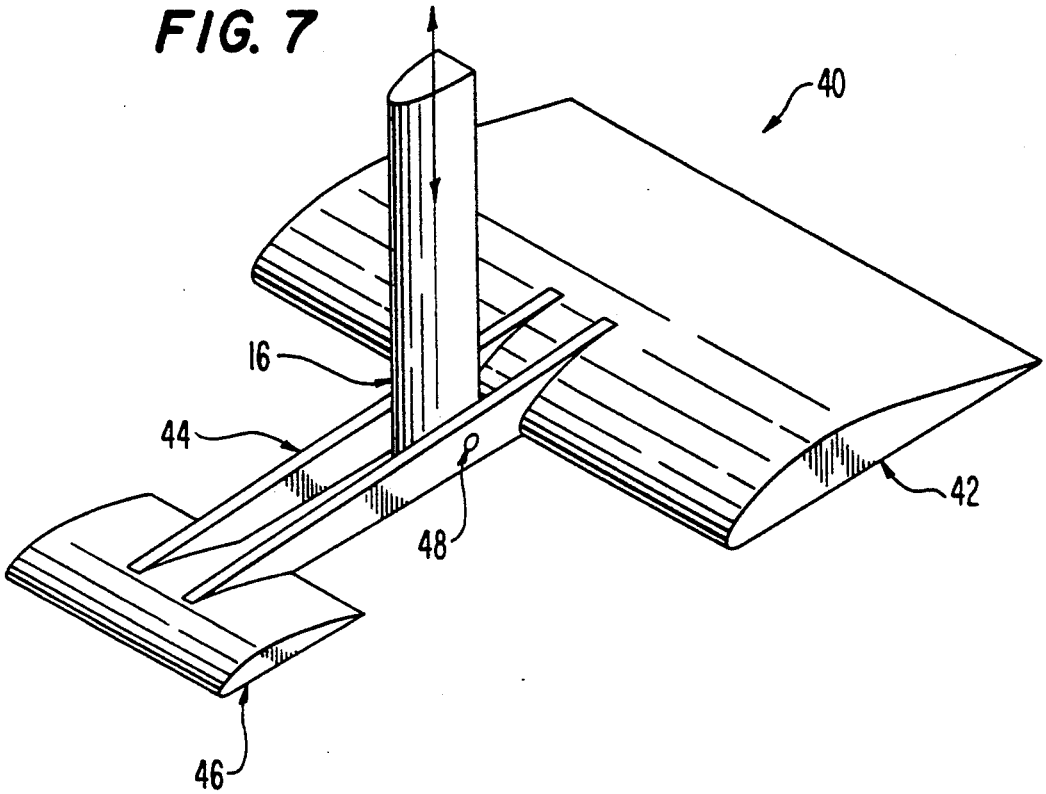
FIG. 7 is a perspective view depicting a canard tandem foil arrangement which is stabilized by the forward foil.

FIG. 7 depicts a tandem foil arrangement 40 which is stabilized by the forward foil 46. The tandem foil arrangement 40 has an aft foil 42 which is attached to a connecting structure 44 and a forward foil 46 which is also attached to the connecting structure 44. The tandem foil arrangement 40 is pivotally attached to the support arm 16 by any means known in the art, preferably by a pitch hinge, at a pivotal attachment or connection site 48. When the tandem foil arrangement 40 encounters a change in vertical water velocity, the angle at which the forward foil 46 attacks the approaching water is greater than the angle at which the aft foil 42 attacks the approaching water, the result of which being that the lift created by the forward foil 46 returns the tandem foil arrangement 40 to its original angle of incidence to the new relative water flow direction.

Figure 8:
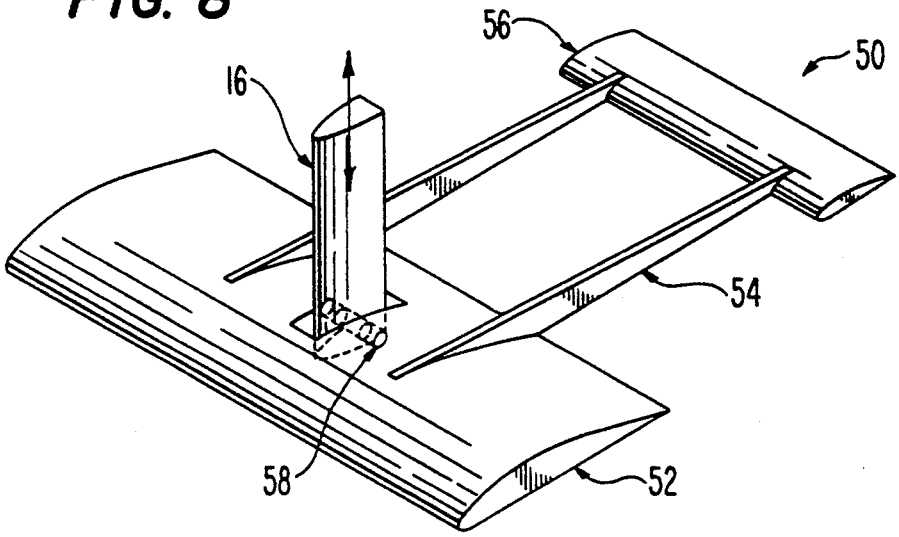
FIG. 8 is a perspective view depicting a tandem foil arrangement which is stabilized by the aft foil.

FIG. 8 depicts a tandem foil arrangement 50 which is stabilized by the aft foil 56. The tandem foil arrangement 50 has a forward foil 52 which is pivotally attached to the support arm 16 at an attachment or connection site 58 by any means known in the art, preferably a pitch hinge. The forward foil 52 is attached to a connecting structure 54 which, in turn, is attached to an aft foil 56. This aft foil 56 acts in the same way as the forward foil 46 of the tandem foil arrangement 40 acts; that is, when the tandem foil arrangement 50 encounters a change in vertical water velocity, the lift created by the aft foil 56 restores the tandem foil arrangement 50 to its original angle of incidence to the new relative water flow direction.

When the hull 12 has a very slender configuration, the foils 20 are preferably smaller than the foils typically found on conventional hydrofoil craft. These smaller foils can be used in combination with the slender hull because the slender hull can remain in nominal contact with the water up to a higher speed before "takeoff" than is possible with conventional hulls. This phenomenon increases the cruise efficiency of the hydrofoil because the foils can be smaller.

Figure 1:
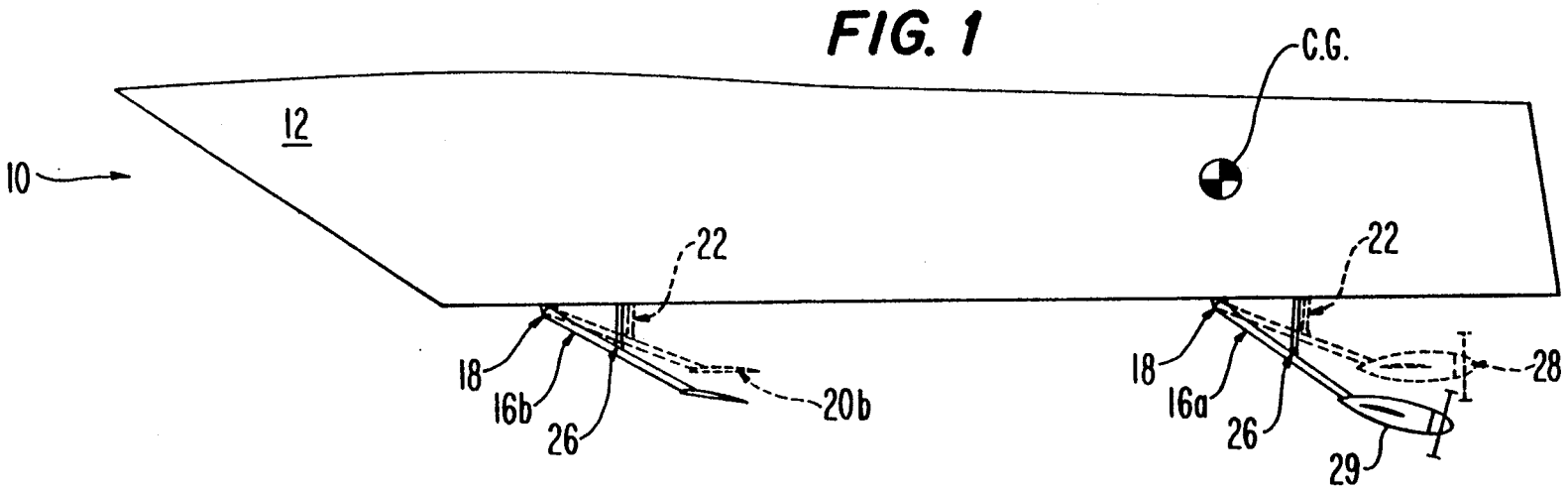
FIG. 1 is a side elevational, partially schematic view showing the unique hydrofoil craft of the present invention with means for allowing the foils to move in concert with the upgusts and downgusts of water velocity around the foils.
Figure 2:
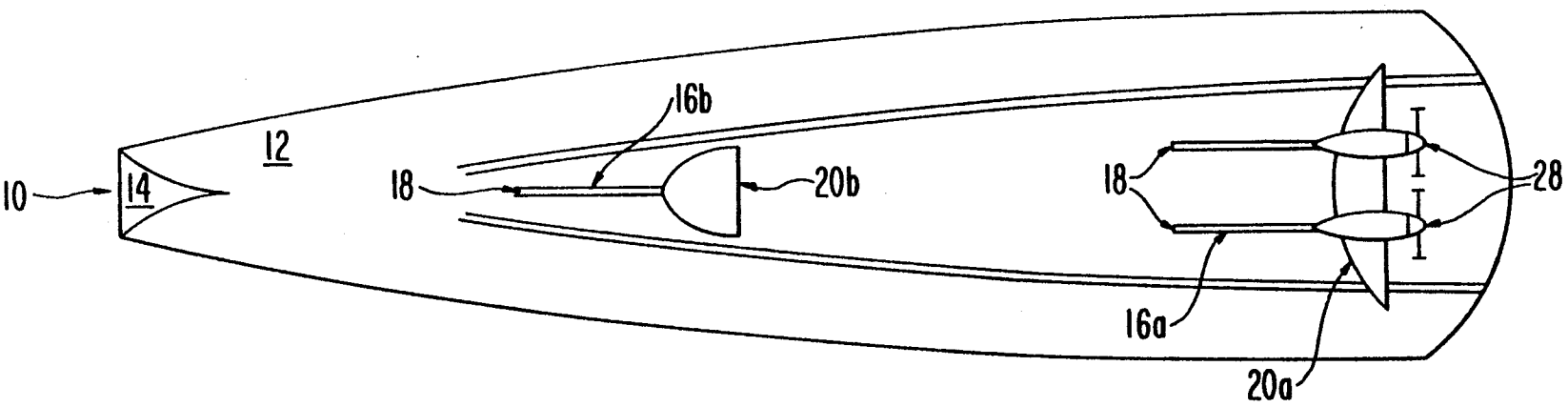
FIG. 2 is a bottom plan view showing the unique hydrofoil craft of the present invention.

According to one aspect of the present invention, support arms 16 which extend angularly downward from the hull 12 into the water and which are not at least partially flexible are held in a downward, angular position by shock struts 22 which are connected to the support arms 16 by pivotal connection 26 and connected at or near the bottom of the hull 12 by pivotal attachment or connection 24 through any means known in the art, as is shown in FIG. 1. These shock struts 22 provide means which allow the support arms 16 and the foils 20 to move in concert with the changes in water velocity around the foils 20. Suitable shock struts 22 include, but are not limited to, mechanical compression springs, hydraulic cylinders, and pneumatic cylinders. Where cylinders are used as shock struts 22, accumulators are typically used in concert with the cylinders to reduce the spring rate or change its characteristics, as is well-known in the art.

As is depicted in FIG. 3, the shock struts 22 allow the support arms 16, and thus the foils 20, to move in concert with the changes in vertical water velocity (upgusts and downgusts) in waves located around the foils. If the water velocity around the foil 20 is locally going down (downgusts) as is the case of 3(*c*), the foil's lift is reduced and the shock struts 22 force the foil 20 to move in concert with the water and go down with it almost instantly. On the other hand, where the water velocity is locally going up (upgust) as is the case of 3(*a*), the foil's lift is increased and the shock strut 22 allows the foil 20 to go up with it almost instantly. Thus, the shock struts 22 allow the foils 20 to move almost instantaneously in response to these local upgusts and downgusts of water velocity. Because the support arms 16 are pivotably and not rigidly attached to the hull 12, this instantaneous foil movement does not affect the movement of the hull 12 of the boat: the foils 20 move independent of the hull 12 of the boat. Accordingly, this support arm 16/shock strut 22/foil 20 construction allows the hull 12 of the boat to track a path of approximately constant elevation above the water's surface while the foils 20 move in concert with the local upgusts or downgusts of water velocity, thus affording the hull 12 of the boat a smooth ride in rough waters.

Figure 9:
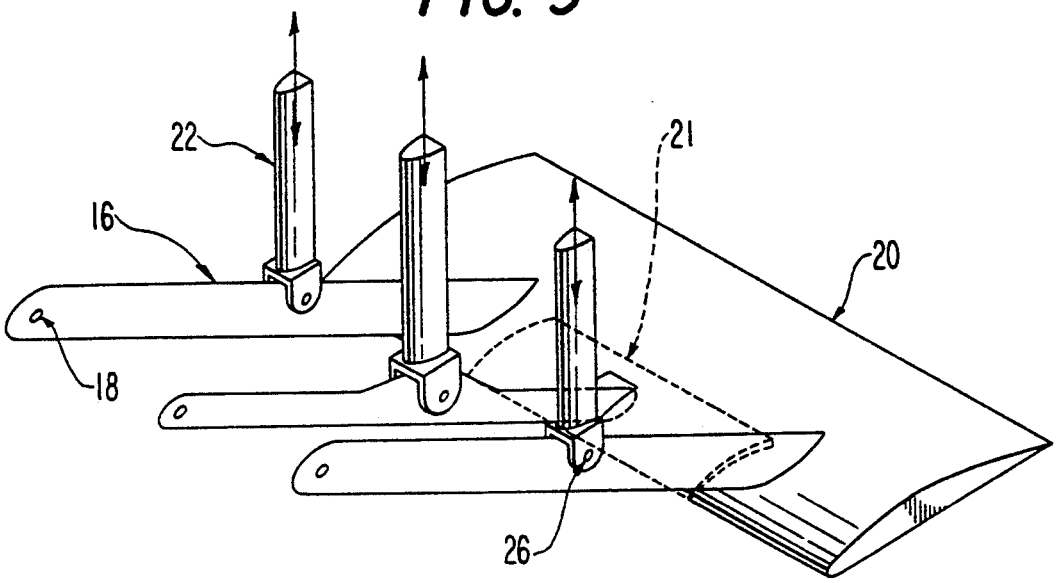
FIG. 9 is a perspective view showing both foils of a dual foil system, which can be used to reduce foil resistance at high speeds, both in a downward position.
Figure 10:
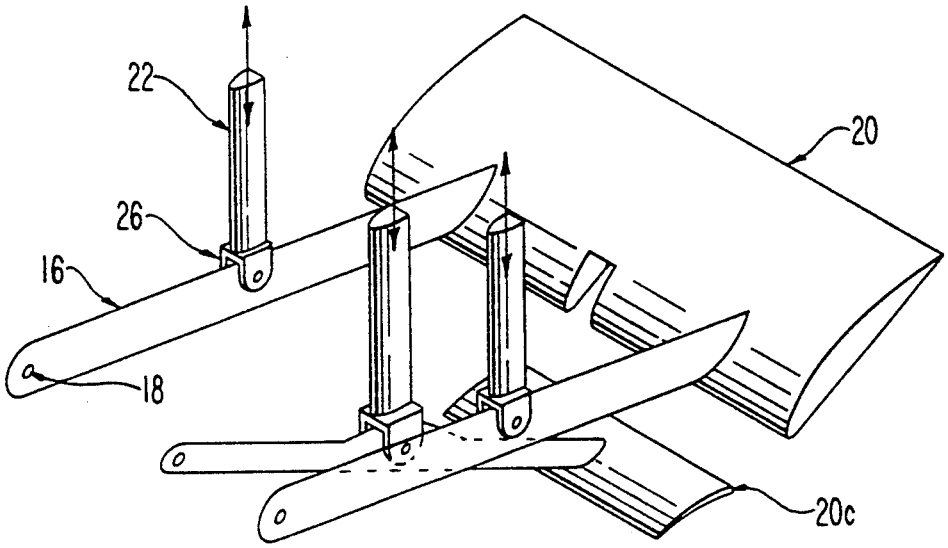
FIG. 10 is a perspective view depicting a dual foil system which can be used to reduce foil resistance in the water by lifting one of the foils out of the water.

Furthermore, the support arm 16/shock strut 22/foil 20 system permits another way in which the size of the main foil 20*a* may be reduced at high speeds, thus reducing the resistance of the hydrofoil craft 10 at high speeds. As is shown in FIG. 9, two "main foils" can be down in the water at low speeds: one large foil 20 for low speed operation and a small foil 20(*c*) for high speed operation. At low speeds these foils can be nested together or they can be in tandem. On reaching a high enough speed for the small foil 20(*c*) to be able to support the weight of the craft 10 by itself, the large foil 20 is lifted out of the water so that it rests against, or close to, the bottom of the hull 12 by retracting the shock struts 22 which were previously holding it down, as is shown in FIG. 10. Preferably, the large foil 20 is hinged near its leading edge with respect to its support arm[s] so that the foil 20 points into the relative water flow when retracted. All of the weight of the hull 12 is then carried by the shock strut 22 which holds down the support arm 16 which is attached to the smaller foil 20(*c*).

In addition to greatly reducing the resistance of the craft 10 at high speeds, this method permits different types of foil to be employed at low and high speeds. The low speed foil would typically have a sectional shape similar to that of an aeroplane wing, with a rounded leading edge, known as a "subcavitating foil", which can efficiently develop high lift coefficients. The small foil 20(*c*) for high speeds, on the other hand, would typically be of the "supercavitating" type, designed to operate with an air-filled cavity above its upper surface.

The support arm 16 which is attached to the large foil 20 preferably has conventional streamline sections, e.g., the support arm 16 possesses leading and trailing edges which are more narrow relative to the center of the support arm 16, so that atmospheric air cannot find its way down the support arm 16 to vent the upper surface of the foil 20 and thus reduce its lift. The support arm 16 which is attached to the small foil 20(*c*), on the other hand, preferably has blunt trailing edges to provide an easy path down the support arm 16 for atmospheric air to ventilate the upper surface of the small foil 20(*c*)

According to the present invention, the angle of incidence at which the foils 20 contact the approaching water is adjusted automatically so as to minimize a reduction in lift when the foils 20 encounter a downgust or minimize an increase in lift when the foils 20 encounter an upgust. This automatic adjustment can be accomplished by any means known in the art or previously discussed herein.

Preferably, the angle of incidence at which the approaching water contacts the foil 20 is adjusted by the same means which adjusts the movement of the foil 20: that is, the angle of incidence is adjusted by the support arm 16/shock strut 22/foil 20 system. This simultaneous adjustment of both the angle of incidence at which the foil 20 attacks the approaching water and the position of the foil 20 in the water by moving the support arms 16 in concert with the changes in vertical water velocity in waves located around the foil 20 is effected by the foil 20 being rigidly connected to the support arms 16. Thus, when the hydrofoil craft 10 encounters a downgust, the foil 20 goes down with the water and, because the foil is rigidly connected to the support arms, the angle of incidence at which the foil 20 contacts the water is necessarily adjusted so as to minimize a reduction in lift. Conversely, when the hydrofoil craft 10 encounters an upgust, the foil 20 goes up with the water and the angle of incidence at which the foil 20 contacts the approaching water is automatically adjusted so as to minimize an increase in lift. This system allows not only the foil's location in the water but also the angle of incidence at which the foil contacts approaching water to be adjusted instantaneously, thus affording the hull 12 of the boat a smooth ride in rough water. Accordingly, in preferred embodiments no foil-mounted control mechanisms are necessary.

According to one aspect of the present invention, the foil 20 in the support arm 16/shock strut 22/foil 20 system can be a foil 30 with a hinged flap. Preferably, the hinge line is close to the leading edge of the foil 30. Using a foil 30 with a hinged flap in this position results in the hinged flap "feathering" into the relative water flow when it encounters a downgust of vertical water velocity and being held against a stop when it encounters an upgust of vertical water velocity, thus minimizing the resistance of the foil 20 when it is in a retracted position.

According to another aspect of the present invention, support arms 16 which extend angularly downward from the hull 12 into the water and which are at least partially flexible are held in a downward, angular position by an attachment or connection 18 which is rigid. The flexible nature of the support arms 16 allows the support arms 16 to bend in response to the changes in water velocity around the foils 20 almost instantaneously and thus to move in concert with the local upgusts or downgusts of water velocity. Because the flexible support arms bend in response to the changes in vertical water velocity around the foils 20, the instantaneous movement does not affect the movement of the hull of the boat, thus affording the hull 12 of the craft a smooth ride. Moreover, the same mechanism which adjusts the location of the foil 20 in the water preferably adjusts the angle of incidence at which the foil 20 attacks the approaching water. As is previously described, the angle of incidence at which the foils 20 contact the approaching water is preferably adjusted by rigidly attaching the foils 20 to the flexible support arms so that the angle of incidence at which the foils 20 contact the approaching water is adjusted by the same means which adjusts the movement of the foils 20, although any means of adjusting the angle of incidence which has been previously been discussed or which is well-known in the art can be used.

According to yet another aspect of the present invention, telescoping support arms 16 which are not at least partially flexible and which extend vertically downward from the plane of the bottom of the hull 12 into the water can be used. The telescoping nature of these support arms 16 allows the foils 20 to move in concert with the changes in vertical water velocity around the foils, as is depicted in FIG. 11, and thus affords the hull 12 of the craft 10 a smooth ride. Again, it is preferred that the same mechanism which adjusts the position of the foil 20 in the water also adjusts the angle of incidence at which the foil 20 attacks the approaching water. Although any means of adjusting the angle of incidence which has been previously discussed or which is well-known in the art can be used, preferably, the angle of incidence at which the foils 20 contact the approaching water is adjusted by pivotally attaching a hinged link 60 to the foil 20 and the support arm 16 at pivotal attachment or connection sites 62 and 64, respectively. When the foil 20 encounters a change in vertical water velocity, the foil 20 moves in concert with the water due to the telescoping nature of the support arm 16 and the angle of incidence at which the foil 20 encounters approaching water is automatically adjusted due to the hinged link 60 changing the position of the foil 20 upon movement of the support arm 16, as is shown in FIG. 11.

Another advantage which the hydrofoil craft 10 of the present invention possesses is that the hydrofoil craft 10 can use supercavitating foils because it has the ability to move its foils 20 up and down in concert with the changes in vertical water or air velocity located around the foils 20. A supercavitating foil is a foil which at high speeds does not have any water flow contacting the upper surface of the foil, thus creating a cavity above the foil. At high speeds in calm water, this cavity contains only water vapor at very low pressure. If a supercavitating foil is at a low enough angle of incidence for efficient (low drag) operation, the vaporfilled cavity is unstable and the forces on the foil very randomly and violently. If such a foil gets too close to the surface of the water, the low pressure of the vapor cavity can suck in atmospheric air causing the foil's lift to fall to about one-third of its supercavitating value. See, Conolly, Alan, "Prospects For Very High Speed Hydrofoils," *Marine Technology*, Volume 12, No. 4, pp. 367-377 (1975). It is believed that because of this sudden decrease in lift when a supercavitating foil gets too close to the water's surface, such supercavitating foils are not in practical use today. However, such supercavitating foils can be employed on the hydrofoil craft 10 of the present invention because the rapid changes in lift caused by the instability of the cavity merely causes the support arms 16 attached to the craft 10 to move up and down appropriately so as to reduce or to increase the angle of incidence of the foils 20 so as to maintain lift, thus assuring the hull 12 of the craft 10 a smooth ride.

Furthermore, where the support arms 16 extend angularly downward from the hull 12 of the craft 10 into the water, the resistance of such supercavitating foils, for a given lift, is minimized by the fact that atmospheric air is continuously available to the cavity above the foil due to the angle at which the support arms 16 are inclined. Having the support arms 16 inclined at an angle to vertical, $\theta$, as is depicted in FIG. 3, results in a significant decrease in the amount of drag and, therefore, resistance which is due to the dynamic pressure of the water contacting the support arms 16. For example, where $\theta=60°$ (a typical value for $\theta$), $\cos\theta=0.5$ and, therefore, the ratio $$\frac{\text{inclined support arm drag}}{\text{vertical support arm drag}}$$

(which is approximately equal to $\cos^2\theta$) is approximately 0.25: thus, the pressure drag which results from the water contacting a support arm 16 which extends angularly downward is only 0.25 or 25% of the pressure drag which results from a vertical support arm contacting water. Accordingly, a support arm 16 which extends angularly downward from the hull 12 can be four times as wide as a vertical support arm while being subject to an equivalent amount of drag, and the cross-sectional area of the cavity behind the support arm 16 which extends angularly downward can be sixteen times as great as the cavity behind a vertical support arm, thus permitting sixteen times as much air to flow down behind the inclined support arm.

Furthermore, in the present invention, the foil 20 can be attached to the inclined support arm 16 by or near to its leading edge. Therefore, the atmospheric air traveling down the back of the inclined support arm 16 does not need to force its way against the water flow because it is already upstream of the cavity which it must feed. Furthermore, if no cavity already exists above the foil, this atmospheric air traveling down the back of the support arm will allow one to form as soon as it reaches the leading edge of the foil.

In preferred embodiments, the resiliency and damping characteristics of the shock strut 22/support arm 16/foil 20 system can be instantly changed, at the flip of a switch, from the wheelhouse of the hydrofoil craft 10. Changing these characteristics allows the hull 12 of the boat to obtain the optimum ride comfort in varying sea conditions. The manner in which the characteristics of the shock strut 22/support arm 16/foil 20 system can be changed depends upon the particular embodiment of this system.

For example, where the shock strut 22 is a hydraulic cylinder, the pressure of the gas in the accumulator which is connected to the hydraulic cylinder can be decreased to soften the ride or increased to stiffen the ride, depending on the condition of the sea. This adjustment can easily be controlled from the wheelhouse of the hydrofoil craft 10.

Also in preferred embodiments, the shock strut 22/support arm 16/foil 20 system can be controlled from the wheelhouse such that this system, at the flip of a switch, can be stored close to the hull 12 of the craft so that the foils 20 fit snugly against the bottom of the hull 12. When the foils 20 are stored snugly against the hull 12, the hydrofoil craft 10 can operate with reduced draft at low speeds.

According to the present invention, propeller assemblies 28 can be mounted anywhere on the hydrofoil craft 10. Preferably, the propeller assembly 28 is mounted on or behind at least one foil 20 and, more preferably, the propeller assembly 28 is mounted on the main foil 20*a* because it is the only part of the hydrofoil craft 10 which is in unequivocal water contact nearly all of the time. However, this is more costly than a conventional propeller installation and, therefore, may not always be economically desirable.

The propeller assembly 28 can include at least one propeller attached to the output member of a hydraulic motor which is mounted in a pod located on or behind the foil 20. The hydraulic motor and thus the propeller are driven by pressurized fluid from a hydraulic pump mounted on the engine of the hydrofoil craft 10. Two hydraulic lines which are attached at one end to the hydraulic motor and at the other end to the hydraulic pump carry the pressurized fluid back and forth between the hydraulic motor and the hydraulic pump. The hydraulic lines either must be flexible or incorporate a mechanical hinged joint so as to allow the foil to which the pod and hydraulic motor are attached to move in concert with the changes in water velocity around the foils.

Preferably, the hydraulic pump which is mounted on the engine of the hydrofoil craft 10 is a variable displacement pump. The variable displacement pump pressurizes the hydraulic fluid at a constant power level, so that if the flow is reduced because the motor is slowed by a greater torque load on the propeller, the fluid pressure increases. Ideally, halving the flow rate doubles the pressure. Thus, at low boat speeds, where the propeller torque is high and the motor is turning slowly, the fluid pressure is also high, maximizing the torque available in the motor. The overall effect is that of a variable gear ratio between the engine and the propeller.

In other embodiments, the propeller assembly 28 can include at least one propeller attached to the output member of an electric motor which is mounted in a pod located on the foil 20. Any device known in the art for transporting electric current through a rotating joint may be used to transport electric current produced by generators mounted on the engines of the hydrofoil craft 10 to the electric motor so as to drive the electric motor and thus the propeller. Preferably, either flexible wires or hinged commutators transport the electric current so as to allow the foil, which can be attached to the pod, to move in concert with the changes in water velocity around the foils 20.

Finally, the propeller assembly 28 can include at least one propeller attached to a mechanical transmission means. Where the propeller is mounted on a foil 20, the mechanical torque needed to drive the propeller is transmitted from the engine to the propeller through input (from the engine) and output (to the foil) shafts which are connected by a joint or linkage which can accommodate the up and down movement of the foil 20 so that the foil 20 can move in concert with the changes in vertical water velocity located around the foil 20. For example, a Hooke's joint, constant velocity joint, or a flexible rubber coupling which is coincident with the hinge axis center line of the foil 20/support arm 16 hinges can be used to connect the input and output shafts. Preferably, a gear box which allows the output shaft to swivel about a horizontal axis which is coincident with the foil 20/support arm 16 hinge center line is used. An example is a gear box which has two beveled gears facing each other and which is orthoganol to the water's surface. Driving pinions interact with and engage the beveled gears. One driving pinion is attached to a shaft which, in turn, is attached to the engine of the hydrofoil craft. This driving pinion allows the mechanical transmission of energy from the engine of the hydrofoil craft to the gear box. The other driving pinion is attached to a shaft which extends from the beveled gear box to a lower gear box located near the propeller. This shaft allows the mechanical transmission of energy from the beveled gear box to the lower gear box. Where the shaft from the upper gear box is at an angle of 30° to the water's surface so that it enters the lower gear box at this angle, the lower gear box has an output shaft which is roughly longitudinal, or parallel to the water's surface. Thus, in this example, the angle between the input and output shafts of the lower gear box is also 30°. The output shaft from the lower gear box, in turn, is attached to at least one propeller located on the foil 20.

Figure 12A:
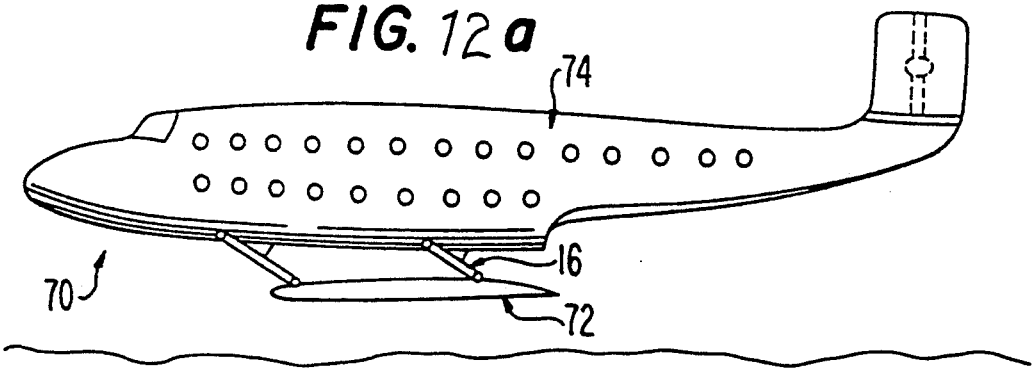
FIGS. 12*a* and 12*b* are side elevational views showing the unique WIG aircraft of the present invention with means for allowing the wings to move in concert with the changes in vertical velocity around the wings, wherein the means which allows movement is a shock strut/support arm/wing system FIG. 12*a* illustrating an embodiment with a wing mounted below the aircraft and FIG. 12*b* illustrating an embodiment with a wing mounted above the aircraft.
Figure 12B:
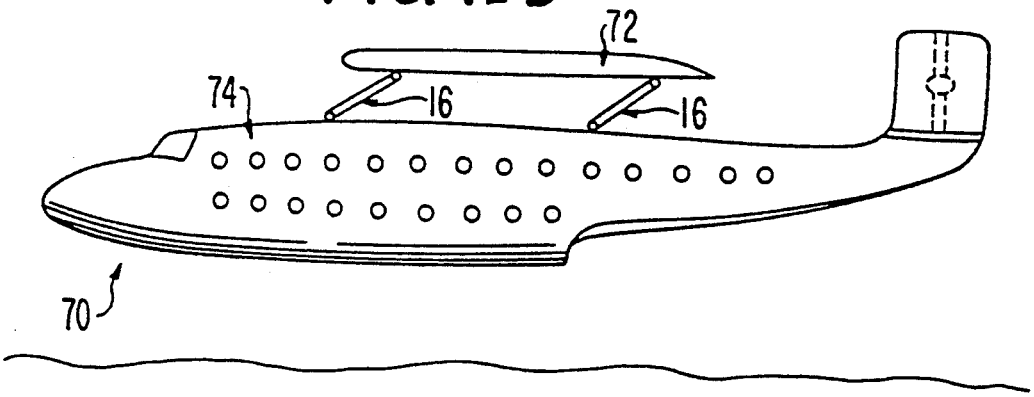
Figure 13A:
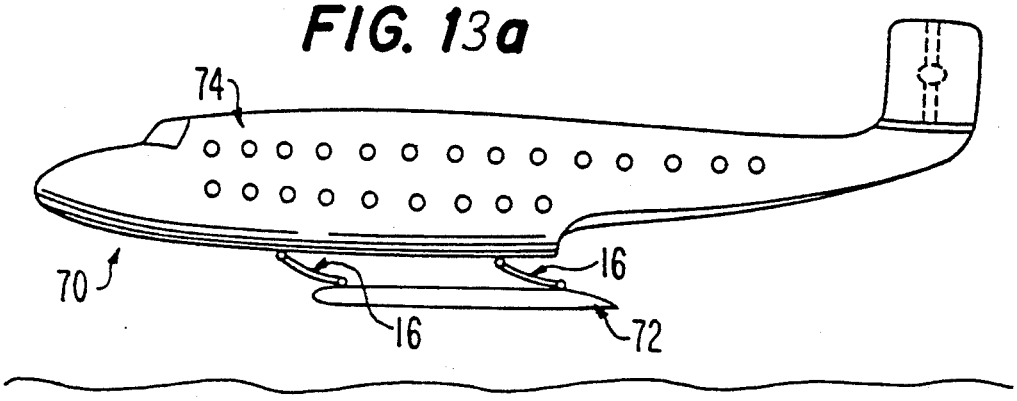
FIGS. 13*a* and 13*b* are side elevational views showing the unique WIG aircraft of the present invention with means for allowing the wings to move in concert with the changes in vertical velocity around the wings, wherein the means which allows movement is a flexible support arm, FIG. 13*a* illustrating an embodiment with a wing mounted below the aircraft and FIG. 13*b* illustrating an embodiment with a wing mounted above the aircraft.
Figure 13B:
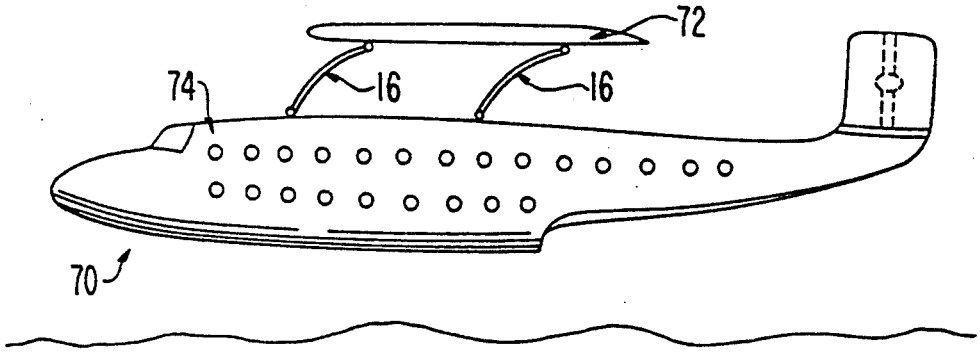
Figure 14A:
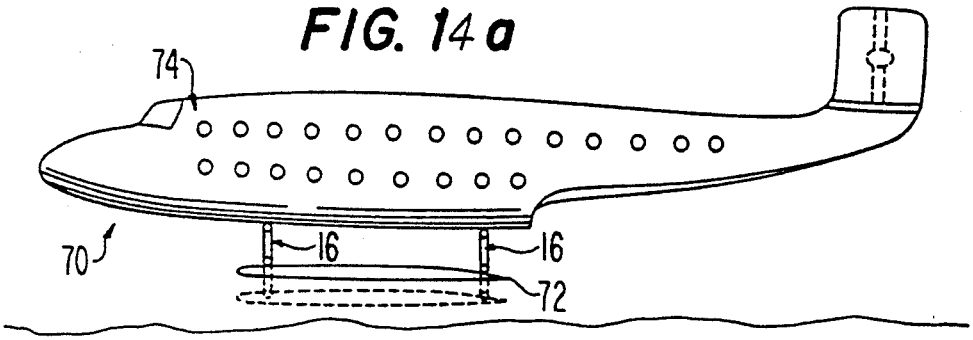
FIGS. 14*a* and 14*b* are side elevational views showing the unique WIG aircraft of the present invention with means for allowing the wings to move in concert with the changes in vertical velocity around the wings, wherein the means which allows movement is a vertical support arm which is telescoping in nature, FIG. 14*a* illustrating an embodiment with a wing mounted below the aircraft and FIG. 14*b* illustrating an embodiment with a wing mounted above the aircraft.
Figure 14B:
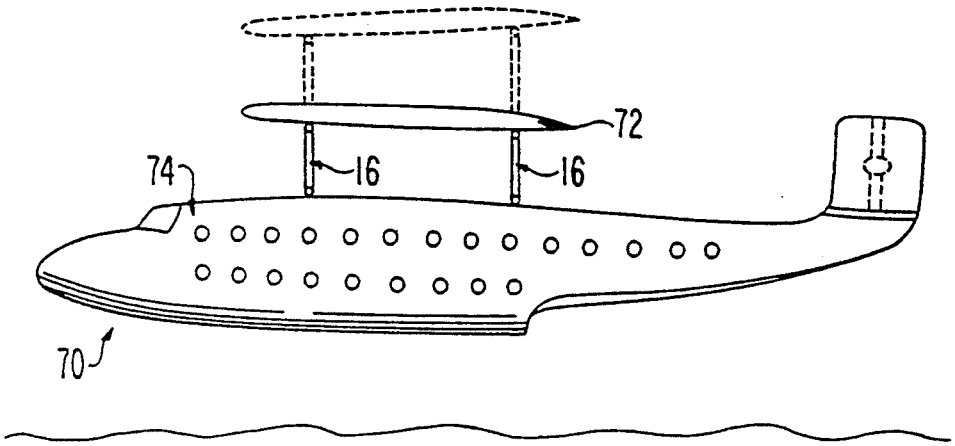

According to another aspect of the present invention, the previously described mobile support arm systems which allow a foil 20 to move in concert with the changes in local vertical water velocity can be equally applied to WIG aircraft 70, as is shown in FIGS. 12–14. The only difference between the mobile support arm systems when they are applied in a WIG 70 and when they are applied in a hydrofoil 10 is that in a WIG 70 the support arm 16 is attached to a wing 72 rather than a foil 20. Nonetheless, the same support arm systems can be used in WIGS 70 and hydrofoils 10 because the lift creating sections, i.e. foils 20 and wings 72 function similarly: they both create lift by the angle at which they attack the approaching fluid, i.e. air or water.

Using these support arm systems allows a WIG 70 to maintain approximately constant lift because these support arm systems allow the wing 72 to move in concert with the random changes in lift caused by the proximity of the wing 72 to the water's surface or by head or following winds. Thus, using these support arm systems allows a WIG 70 to fly comfortably and efficiently just above the water's surface. Preferably, two support arms are attached to one wing, as is shown in FIGS. 12–14. Moreover, the support arm 16 can be attached either at or near the bottom of the fuselage 74 or at or near the top of the fuselage 74, as is shown in FIGS. 12–14.

As can be seen, this invention provides a unique method for allowing hydrofoils and WIG craft to operate in or above rough waters at high speeds. Moreover, the hydrofoil craft and WIG craft of the present invention contains a unique system which allows the foils or wings attached to the support arms extending from the main body section (i.e., hull or fuselage) to move in concert with the changes of vertical velocity of the fluid (i.e., water or air) around the foils or wings.

What is claimed is:

1. A hydrofoil craft comprising:

a hull having a longitudinal centerline plane;

a support arm rigidly connected to the hull and extending from the hull into the water; and a foil attached to the support arm and extending transversely with respect to the centerline plane, wherein the support arm is sufficiently flexible to enable the support arm and the foil to move with respect to the hull parallel to the centerline plane in concert with upgusts and downgusts of water located around the foil by bending of the support arm with respect to the hull so that the hull maintains an approximately constant elevation above the water.

2. The hydrofoil craft of claim 1, wherein the foil extends perpendicular to the centerline plane.

3. The hydrofoil craft of claim 1 wherein the hull includes a bow transom for preventing complete bow submergence.

4. The hydrofoil craft of claim 1 wherein the hull is a slender hull for enabling the hydrofoil craft to cut through higher waves without large vertical accelerations.

5. The hydrofoil craft of claim 1, comprising power transmission means attached to the hull for propelling the hull.

6. The hydrofoil craft of claim 5 wherein the power transmission means comprises a propeller connected to the hull.

7. The hydrofoil craft of claim 1, wherein the foil is a supercavitating foil.

8. The hydrofoil craft of claim 7, wherein the foil has a leading edge attached to the support arm.

9. A hydrofoil craft comprising:

a hull having a longitudinal centerline plane;

a support arm extending from the hull into the water and comprising a first portion connected to the hull, a second portion coupled to the first portion for reciprocating movement with respect to the first portion, and biasing means for biasing the second portion in a direction away from the first portion;

a foil extending transversely with respect to the centerline plane and having a first pivot point and a second pivot point, the second pivot point being pivotably connected to the second portion of the support arm so that an angle of incidence of the foil varies as the second portion reciprocates; and a link having a first end pivotably mounted on the first portion of the support arm and a second end pivotably mounted on the first pivot point of the foil

10. The hydrofoil craft of claim 9, wherein the first pivot point is disposed forward of the second pivot point in the longitudinal direction of the hull.

11. The hydrofoil craft of claim 9 wherein the biasing means comprises a spring connected between the first and second portions of the support arm.

12. The hydrofoil craft of claim 9 wherein the first portion of the support arm is rigidly connected to the hull.

* * * * *